US006390589B1

(12) United States Patent
Imanaka et al.

(10) Patent No.: US 6,390,589 B1
(45) Date of Patent: May 21, 2002

(54) HEAD SUBSTRATE, INK JET HEAD, AND INK JET PRINTER

(75) Inventors: Yoshiyuki Imanaka, Kawasaki; Masahiko Ogawa, Hino; Ichiro Saito, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/422,563

(22) Filed: Oct. 21, 1999

(30) Foreign Application Priority Data

Oct. 27, 1998 (JP) ..... 10-306178

(51) Int. Cl.[7] ..... B41J 29/393; B41J 2/05
(52) U.S. Cl. ..... 347/19; 347/56; 347/61
(58) Field of Search ..... 347/19, 20, 26, 347/44, 48, 56, 58, 59, 62, 61

(56) References Cited

U.S. PATENT DOCUMENTS

| | | | | |
|---|---|---|---|---|
| 4,694,306 A | | 9/1987 | Ikeda et al. | 347/64 |
| 5,227,812 A | * | 7/1993 | Watanabe et al. | 347/50 |
| 5,504,507 A | * | 4/1996 | Watrobski et al. | 347/19 |
| 5,536,314 A | | 7/1996 | Rannestad | 118/224 |
| 5,635,968 A | * | 6/1997 | Bhaskar et al. | 347/59 |
| 5,841,448 A | * | 11/1998 | Moriyama et al. | 347/19 |

FOREIGN PATENT DOCUMENTS

| | | |
|---|---|---|
| EP | 0571093 | 11/1993 |
| EP | 0766195 | 4/1997 |
| JP | 3-126560 | 5/1991 |
| JP | 8-177732 | 7/1996 |
| JP | 9-150516 | 6/1997 |

* cited by examiner

*Primary Examiner*—Hai Pham
(74) *Attorney, Agent, or Firm*—Fitzpatrick, Cella, Harper & Scinto

(57) ABSTRACT

A head substrate for an ink jet head that discharges ink liquid retained in the ink retaining portion by the ink discharge mechanism in accordance with the printing data inputted from the outside into the data input portion comprises one base substrate having a specific position on the surface for the ink retaining portion to be arranged, and a fuse array storing various readably data freely by selective fusing. This head substrate further comprises a fuse logic circuit for controlling the operation of selective fusing of the fuse array and data reading. Then, the fuse array and the fuse logic circuit are arranged in a position in the direction orthogonal to the surface of the base substrate, but not overlapping with the ink retaining portion. With the fuse array and fuse logic circuit thus structured, this head can be made smaller and lighter in a better productivity as compared with a head for which a ROM chip should be installed separately. Also, it becomes possible to prevent any crack that may occur due to the local heat generated by fusing of the fuse array from being developed into the ink retaining portion for the reliable operation of the head.

10 Claims, 8 Drawing Sheets

HEAD SUBSTRATE, INK JET HEAD, AND INK JET PRINTER

BACKGROUND OF THE INVENTION

1. Field of the Invention

The present invention relates to a head substrate having various layer films laminated on one base substrate, and an ink jet head that utilizes this head substrate. The invention also relates to an ink jet printer that utilizes this ink jet head.

2. Related Background Art

Conventionally, there have been in practice various types of image forming apparatuses, such as a laser printer, an ink jet printer. The ink jet printer is the one that forms images by discharging ink droplets. For the method of ink droplet discharges, there is an electrothermal transducing system which is called a bubble jet type.

The ink jet printer of electrothermal transducing type is arranged to keep ink liquid in the ink retaining portion comprising the nozzles, the supply paths, and the ink reservoir, and to create bubbles by heating ink liquid with the heat generating members in each of the nozzles, and then, to discharge ink droplets from the nozzles by the application of pressure exerted by bubbling of ink liquid.

Generally, for an ink jet printer, an ink jet head, which is structured to enable the ink jet printer to operate as described above, is movably supported by a carrier mechanism to travel in the main scanning direction. Then, in a position to face the ink jet head, a print sheet is sequentially carried by a sheet carrier mechanism in the sub-scanning direction.

In this way, the position where the ink jet head discharges the ink droplets and the surface of the print sheet are made relatively movable in the main scanning direction and the sub-scanning direction, respectively, hence making it possible for the ink jet head to discharge ink droplets onto the surface of the print sheet in accordance with printing data. Therefore, the ink jet head can form on the surface of the print sheet the dot matrix images by the adhesion of ink to it.

The ink jet head is structured by the combination of a head substrate and a covering member, for example. The covering member comprises the layer films that form separation walls, and a cover substrate. The head substrate is provided with one base substrate, and on the surface of this base substrate, various layer films are formed to constitute the ink discharge mechanism and others.

This ink discharge mechanism is formed by heater members for the electrothermal transducing type or formed by piezo members (elements) for the electromechanical transducing type. For a head substrate of the kind, it is generally practiced at present to provide the driver circuit that drives the ink discharge mechanism, and the data input unit through which the printing data are supplied to the driver circuit, by the formation of various layer films on the surface of the base substrate.

Further, for the ink jet head, it is proposed to install the ROM (Read Only Memory) at present on the head substrate in order to hold the data in such a manner as to read out freely the ID (identity) codes of the head itself, and the operational properties of the ink discharge mechanism. For example, in the specification of Japanese Patent Application Laid-Open No. 3-126560, it is disclosed that an EEPROM (Electrically Erasable Programmable ROM) is installed on an ink jet head.

However, the ink jet head disclosed in the above-mentioned Patent Laid-Open Application has the EEPROM which is installed separately from the head substrate. As a result, the device structure is complicated, and the productivity of the heads is not favorable. This complicated structure impedes making the apparatus lighter and smaller. Particularly, when the size of the recording data is large, the conventional ROM chip should be useful, but if the size of the recording data is small enough, it is not necessarily advantageous to provide the ROM chip from the viewpoint of manufacture costs in some cases.

Therefore, in the specifications of Japanese Patent Application Laid-Open No. 8-177732, U.S. Pat. No. 5,504,507, U.S. Pat. No. 5,536,314, or the like, it is disclosed that the ROM having the fuse array on it is formed on the base substrate of the head substrate together with the layer films of the ink discharge mechanism and others.

In this case, when the layer films of the ink discharge mechanism and others are formed on the base substrate, the fuse array that becomes ROM is formed simultaneously at the time of the head substrate manufacture.

If this fuse array is selectively fused by the control of the logic circuit which is formed together with the fuse array at a time, it becomes possible to hold the binary data by the presence and absence of fusing, for example.

Therefore, it is unnecessary to prepare the ROM chip separately from the head substrate for the ink jet heat that utilizes the aforesaid heat substrate. Then, the structure needed for holding the various readable data freely is simplified for the enhancement of the productivity. It also becomes possible to implement making the head smaller.

For the aforesaid head substrate, it is possible to hold the various readable data of the ink jet printer freely by means of the fuse array. Then, the fuse array can be formed on the base substrate together with various layer films. For the general ink jet head, the surface of the head substrate is mostly occupied by the ink retaining unit. Therefore, as shown in FIG. 9A, for example, the fuse array is formed in a position that overlaps with the ink reservoir.

In FIG. 9A, the head substrate 101 of the ink jet head 100 has the fuse member 103, the interlayer insulation film 104, the fuse electrode 105, the protection film 106, and others are appropriately laminated in a specific configuration on the base substrate 102. Then, on the surface of the protection film 106, the ink reservoir 107 is formed by the separation walls (not shown) of the covering member.

In other words, ink liquid 108 faces the fuse member 103 through the protection film 106. However, since the fuse array holds various data by means of the selective fusing of a number of fuse members 103, a considerable amount of heat is generated inevitably when the data recording is executed.

Therefore, when the fuse member 103 is fused in order to hold various date on the fuse array of the ink jet head 100 described above, the crack 190 may occur on the interlayer insulation film 104 and the protection film 106 arranged on the upper layer due to the locally generated heat as shown in FIG. 9B.

In this case, ink liquid 108 in the ink reservoir 107 is allowed to be permeated up to the position of the fuse member 103. As a result, the fuse member 103 thus fused is short circuited by the presence of the ink liquid 108 or the fuse member 103 and the fuse electrodes 105 may be eroded also by the presence of the ink liquid 108, for example.

Particularly when the fused portions of the fuse member 103 or the logic circuit for controlling the data reading drive is formed on the circumference of the fuse array, the logic circuit is also contaminated with the ink liquid 108 which has been permeated from the crack. Then, the malfunction of the fuse array or the logic circuit may take place eventually.

In order to solve a problem of the kind, it may be conceivable to laminate the protection film 106 after the data storage has been completed on the fuse array. However, if, for example, the operational properties of the ink discharge mechanism should be recorded as data on the fuse array, there is a need for fusing the fuse array after the ink jet head 100 is completed and driven.

SUMMARY OF THE INVENTION

With a view to solving the problems discussed above, the present invention is designed. It is an object of the invention to provide a head substrate which does not cause any hindrance brought about by ink liquid even when the fuse array is selectively fused. The invention is also aimed at the provision of an ink jet head that utilizes such head substrate, and an ink jet printer that utilizes such ink jet head as well.

In order to achiever these objectives, a first head substrate of the present invention for an ink jet head that discharges ink liquid retained in the ink retaining portion by the ink discharge mechanism in accordance with the printing data inputted from the outside into the data input portion comprises one base substrate having a specific position on the surface for the ink retaining portion to be arranged, and a fuse array storing various readably data freely by selective fusing. This head substrate further comprises a fuse logic circuit for controlling the operation of selective fusing of the fuse array and data reading. Then, the fuse array and the fuse logic circuit are arranged in a position in the direction orthogonal to the surface of the base substrate, but not overlapping with the ink retaining portion.

Therefore, if an ink jet head is formed by the utilization of this head substrate, it becomes possible for the ink jet head to retain ink liquid in the ink retaining portion formed on the surface of the head substrate. Then, the ink liquid can be discharged as ink droplets by use of the ink discharge mechanism formed on the head substrate. Further, the operational properties thereof and other various data can be stored on the fuse array by use of the fuse logic circuit. Thus, the stored data on the fuse array can be read out freely by use of the fuse logic circuit. Nevertheless, it is arranged that the positions of the fuse array and fuse logic circuit in the direction orthogonal to the surface of the base substrate do not overlap with the ink retaining portion. Therefore, even if a crack should occur by the fusing heat on the upper layer of the fuse array, the crack is not allowed to be permeated to the position of the ink retaining portion.

For the head substrate thus structured, it may be possible to provide the ink discharge mechanism with the heater devices (heater elements) that bubble ink liquid by the application of heat, which are formed on the aforesaid base substrate in a position below the ink retaining portion. In this case, the heater devices formed on the base substrate in the position below the ink retaining portion are arranged to bubble ink liquid by giving heat to it. Then, the ink discharge mechanism discharges ink liquid as ink droplets.

For the head substrate described above, a cavitation proof film is provided at least in a position between the heater device and the ink retaining portion for preventing the cavitation influence of ink liquid, and the cavitation proof film may be formed in the direction orthogonal to the surface of the base substrate up to a position that overlaps with the fuse array and the fuse logic circuit.

In this case, although cavitation occurs when ink liquid is caused to bubble for discharging ink droplets, the influence thus exerted is prevented by the presence of the cavitation proof film. Then, the heater devices are not damaged. Further, the cavitation proof film is formed in the direction orthogonal to the surface of the base substrate up to the position that overlaps with the fuse array and fuse logic circuit. Therefore, even if heat is locally generated by the fusing of the fuse array, the cavitation proof film prevents the influence of such heat so that there is no possibility that the crack that may take place by the fusing head of the fuse array is not allowed to be developed up to the upper layer of the cavitation proof film.

A second head substrate of the present invention for an ink jet head that discharges ink liquid retained in the ink retaining portion by the ink discharge mechanism in accordance with the printing data inputted from the outside into the data input unit (data input portion) comprises one base substrate having a specific position on the surface for the ink retaining portion to be arranged; heater devices formed on the base substrate in a position below the ink retaining portion as the ink discharge mechanism to bubble ink liquid by the application of heat; a cavitation proof film positioned at least in the gap between the heater device and the ink retaining portion for preventing the cavitation influence of ink liquid; and a fuse array storing various readably data freely by selective fusing. This head substrate further comprises a fuse logic circuit for controlling the operation of selective fusing of the fuse array and data reading. Then, the cavitation proof film is formed in the direction orthogonal to the surface of the base substrate up to a position overlapping with the fuse array and the fuse logic circuit.

Therefore, if an ink jet head is formed by the utilization of this head substrate, it becomes possible for the ink jet head to retain ink liquid in the ink retaining portion formed on the surface of the head substrate. Then, the ink liquid can be discharged as ink droplets by use of the heater devices formed on the head substrate for bubbling the ink liquid. Here, although cavitation occurs when ink liquid is caused to bubble for discharging ink droplets, the influence thus exerted is prevented by the presence of the cavitation proof film, and the heater devices are not damaged. The operational properties needed for discharging ink droplets and other various data can be stored on the fuse array by use of the fuse logic circuit. Then, the stored data on the fuse array can be read out freely from the fuse logic circuit. However, in the direction orthogonal to the surface of the base substrate, the cavitation film is formed up to the position where the fuse array and the fuse logic circuit overlap with each other. For example, therefore, even if heat is locally generated due to the fusing of the fuse array, the influence of this heat generating is prevented by the presence of the cavitation proof film. As a result, there is no possibility that the crack that may be created due to the fusing heat of the fuse array is allowed to develop up to the upper layer of the cavitation proof film. Thus, the crack does not take palace in the position of the ink retaining portion to enable ink liquid to be permeated.

A third head substrate of the present invention for an ink jet head that discharges ink liquid retained in the ink retaining portion by the ink discharge mechanism in accordance with the printing data inputted from the outside into the data input unit, comprises one base substrate having a specific position on the surface for the ink retaining portion to be arranged; heater devices formed on the base substrate in a position below the ink retaining portion as the ink discharge mechanism to bubble ink liquid by the application of heat; a cavitation proof film positioned at least in the gap between the heater device and the ink retaining portion for preventing the cavitation influence of ink liquid; and a fuse array storing various readably data freely by selective fusing. Here, the head substrate further comprises a fuse logic circuit for controlling the operation of selective fusing of the fuse array and data reading, and the ink retaining portion and the fuse array are arranged in a position in the direction orthogonal to the surface of the base substrate at least overlapping partly, and the cavitation proof film is formed up to the overlapping position of the fuse array and the fuse logic circuit.

Therefore, if an ink jet head is formed by the utilization of this head substrate, it becomes possible for the ink jet head to retain ink liquid in the ink retaining portion formed on the surface of the head substrate. Then, the ink liquid can be discharged as ink droplets by use of the heater devices formed on the head substrate for bubbling the ink liquid. Here, although cavitation occurs when ink liquid is caused to bubble for discharging ink droplets, the influence thus exerted is prevented by the presence of the cavitation proof film, and the heater devices are not damaged. The operational properties needed for discharging ink droplets and other various data can be stored on the fuse array by use of the fuse logic circuit. Then, the store d data on the fuse array can be read out freely from the fuse logic circuit. However, in the direction orthogonal to the surface of the base substrate, the cavitation film is formed up to the position where the ink retaining portion and the fuse array and the overlap with each other. For example, therefore, even if heat is locally generated due to the fusing of the fuse array, the influence of this heat generating is prevented by the presence of the cavitation proof film. As a result, there is no possibility that the crack that may be created due to the fusing heat of the fuse array is allowed to develop up to the upper layer of the cavitation proof film. Thus, the crack does not take palace in the position of the ink retaining portion to enable ink liquid to be permeated.

For the head substrate described above, it may be possible to form the fuse array with the same material of the heater device. In this case, since the heater devices and fuse array of the ink discharge mechanism are formed by the same material, there is no need for the provision of new additional material when fuse array is formed in manufacturing the head substrate.

For the head substrate described above, a barrier layer is formed on the lower layer of the heater device. Then, the fuse array may be formed with the same material as the barrier layer. In this case, since the barrier layer is formed on the lower layer of the heater device of the ink discharge mechanism, it becomes possible to prevent, with the presence of the barrier layer, the development of hillocks on the lower metallic layer due to heating of the heater device. Now that the barrier layer and the heater devices are formed by the same material, there is no need for the provision of new additional material when fuse array is formed in manufacturing the head substrate.

For the head substrate described above, a print logic circuit having various wiring lines is formed on the base substrate to control the operation of the ink discharge mechanism, and the fuse array is formed with the same material of the wiring lines of the print logic circuit.

In this case, the operation of the ink discharge mechanism is controlled by the logic circuit formed by various wiring lines and others on the base substrate. Then, the ink discharge mechanism is able to discharge ink droplets appropriately. Now that the wiring lines of the logic circuit and the fuse array are formed by the same material, there is no need for the provision of new additional material when fuse array is formed in manufacturing the head substrate.

For the head substrate described above, it may be possible to from the fuse array with the layer film on the lower layer of the heater device. In this case, the fuse array is formed by the layer film on the layer of the heater device of the ink discharge mechanism. For example, therefore, if a crack occurs on the upper layer due to the local heating due to the fusing of the fuse array, the crack thus created is not easily allowed to reach the position of the ink retaining portion.

Also, an ink jet head of the present invention comprises a head substrate manufacture in accordance with the present invention, and a covering member shielding the surface of the head substrate concavely to form the ink retaining portion. Therefore, the ink retaining portion of this ink jet head is formed by the covering member that shields the surface of the head substrate concavely. Then, ink liquid is retained in the ink retaining portion thus formed.

Also, an ink jet printer of the present invention comprises an ink jet head manufacture in accordance with the present invention; ink supply means for supplying ink liquid to the ink retaining portion of the ink jet head; data input means for inputting printing data into the data input unit of the ink jet head; relatively moving means for relatively carrying a recording medium with respect to the ink jet head; and data read means for reading out various data to the fuse logic circuit from the fuse array of the ink jet head.

Therefore, for the ink jet printer of the present invention, the ink supply means supplies ink to the ink retaining portion of the ink jet head. The data input means inputs the printing data to the data input unit of the ink jet head. the relative movement means moves the recording medium relatively with respect to the ink jet head. As a result, the ink jet head discharges ink droplets to the surface of the recording medium in accordance with the printing data. Then, the position thereof moves relatively, hence making it possible to form dot matrix images by the ink droplets that adhere to the recording medium accordingly. The data read means reads out various data from the fuse array to the fuse logic circuit of the ink jet head. For example, therefore, it becomes possible to adjust driving by recognizing the operational properties of the ink jet head from the data thus read out.

In this respect, each of the means referred to in the present invention may be formed in such a way as to implement each of the required functions. A delicately arranged hardware, a computer having appropriate function provided by programs, the functions which are implemented in the computer by the provision of an appropriate program, and the combination thereof, among some others, are regarded as those means hereof, for example.

BRIEF DESCRIPTION THE DRAWINGS

DETAILED DESCRIPTION OF THE PREFERRED EMBODIMENTS

Figure 1:
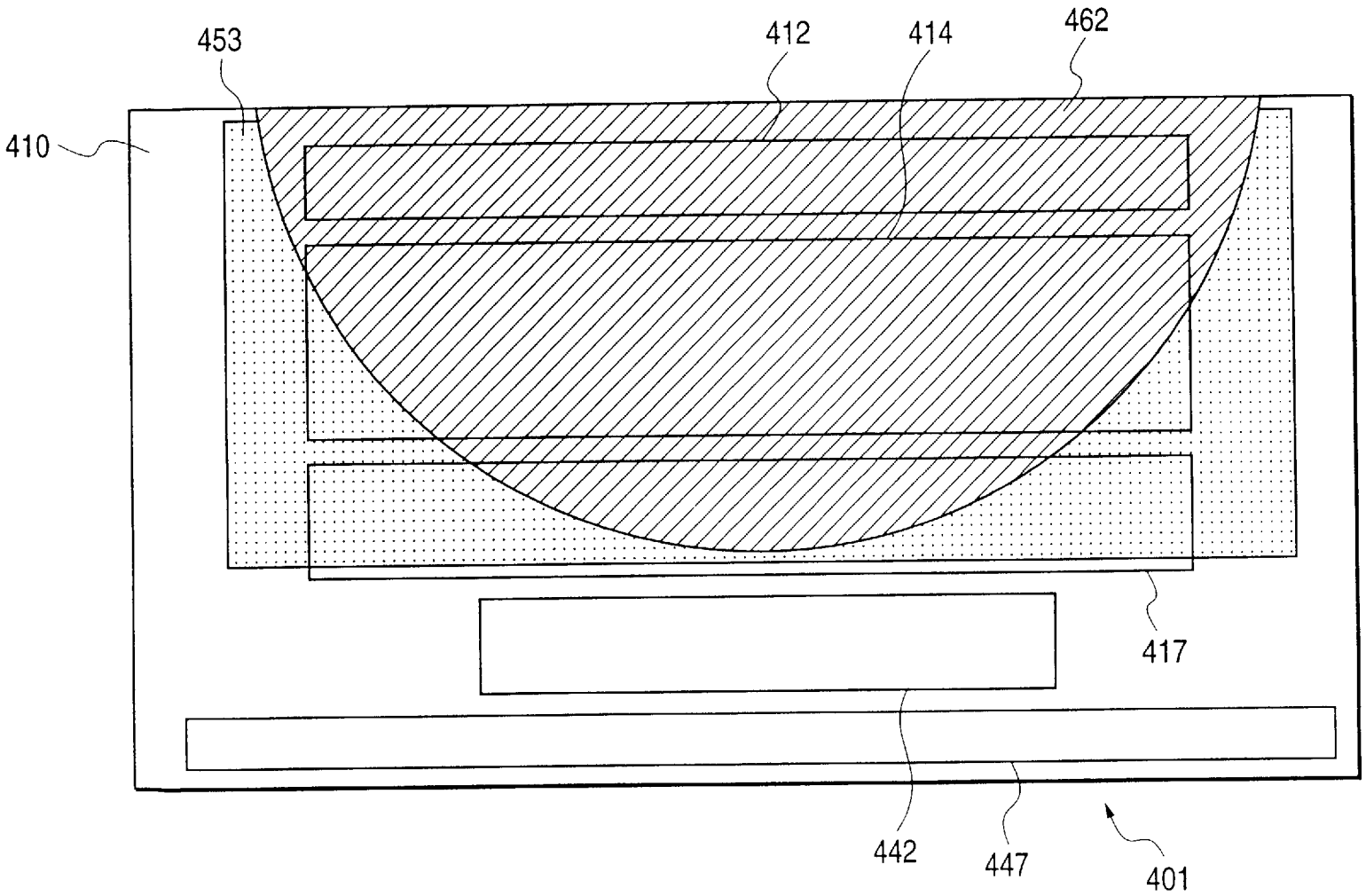
FIG. 1 is a plan view which schematically shows the inner layout of an ink jet head in accordance with a first embodiment of the present invention.
Figure 2:
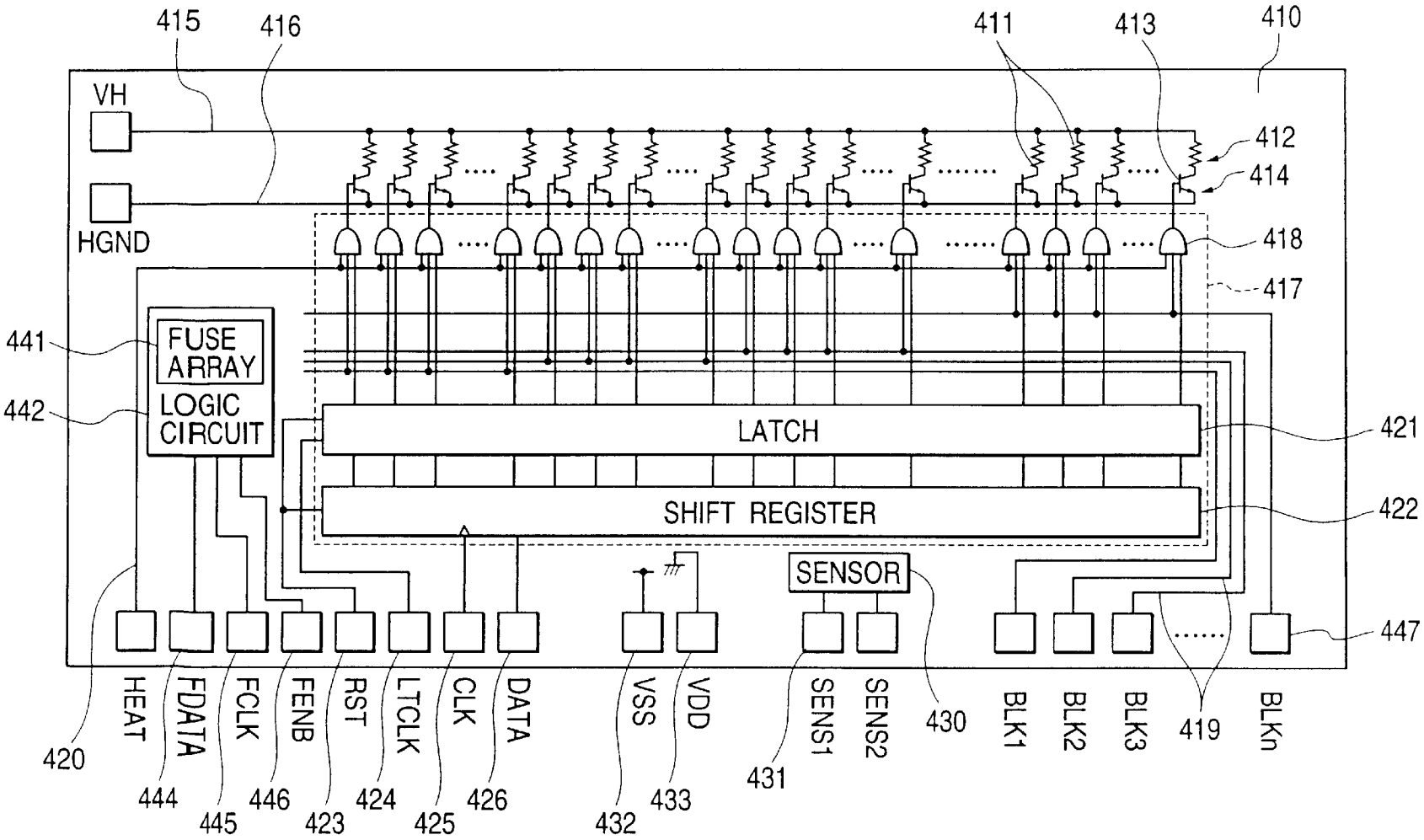
FIG. 2 is a block diagram which schematically shows structure of the layer lamination of the ink jet head.
Figure 3:
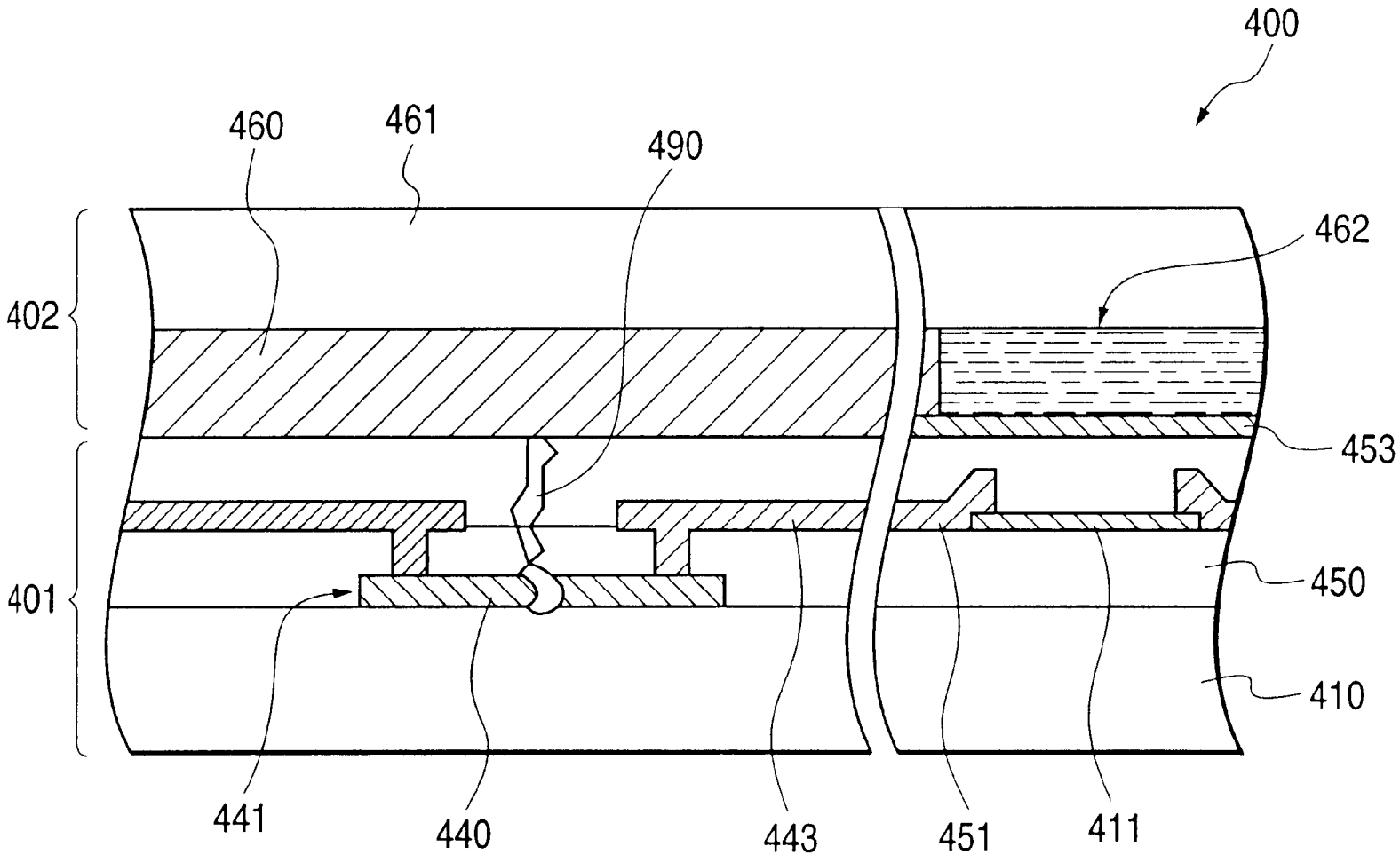
FIG. 3 is a vertically side sectional view which schematically he structure of the layer lamination the ink jet head.
Figure 4:
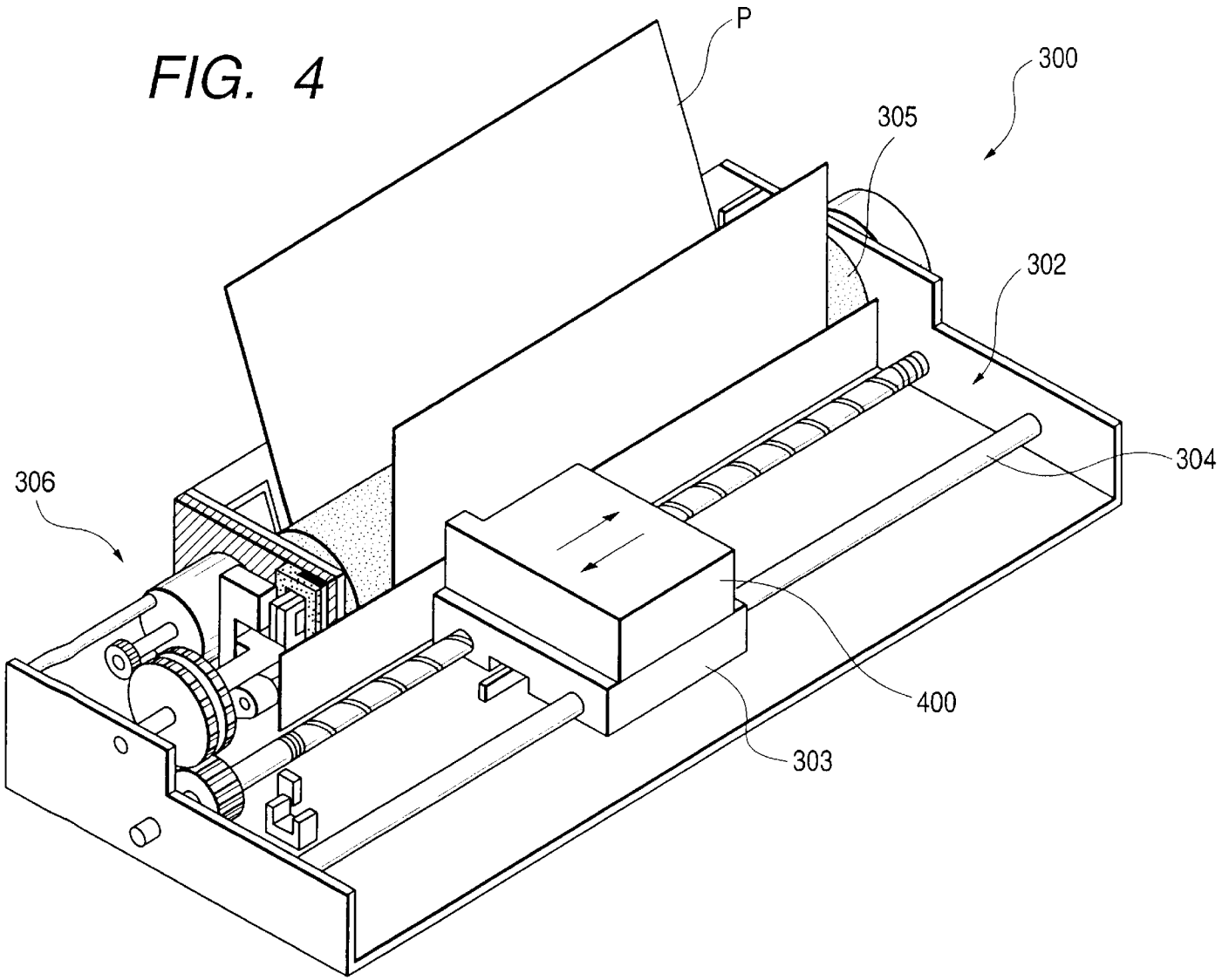
FIG. 4 is a perspective view which shows the external appearance of an ink jet printer.
Figure 5:
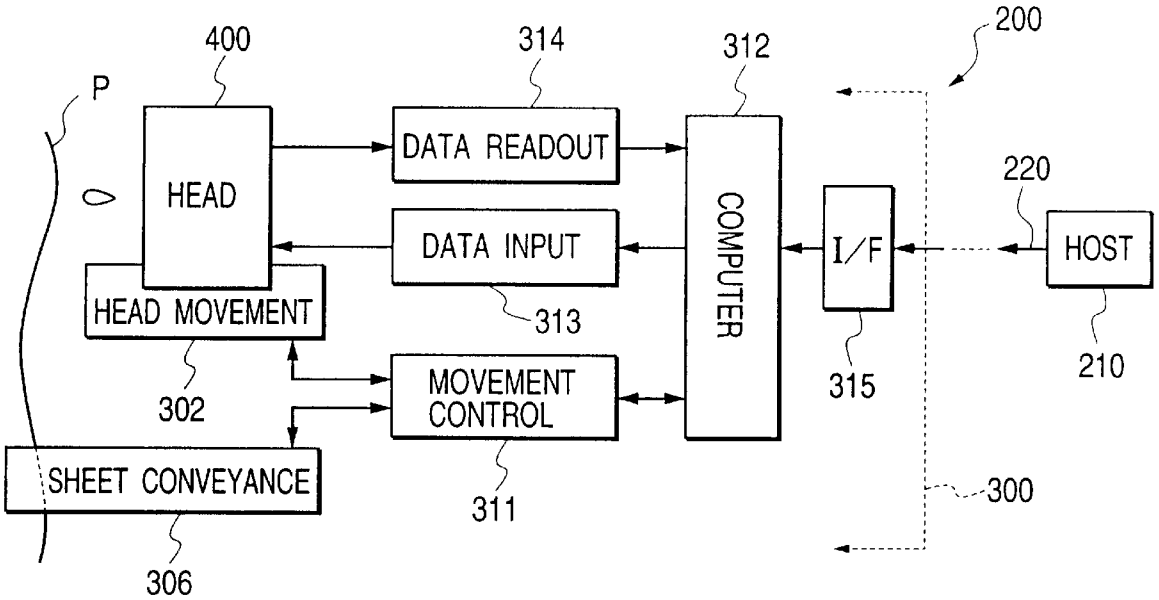
FIG. 5 is a block diagram which schematically shows the structure of the circuit of the ink jet printer.
Figure 6:
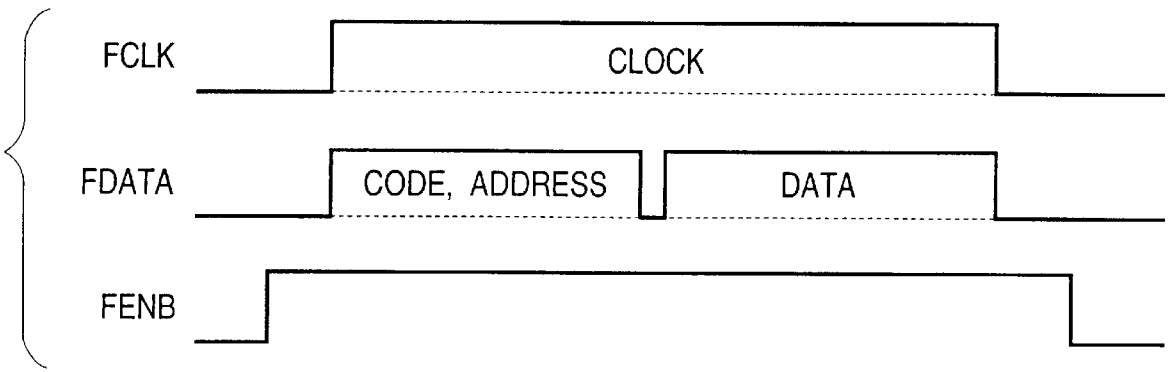
FIG. 6 is a time chart which shows the relationship between each of the various signals.
Figure 7:
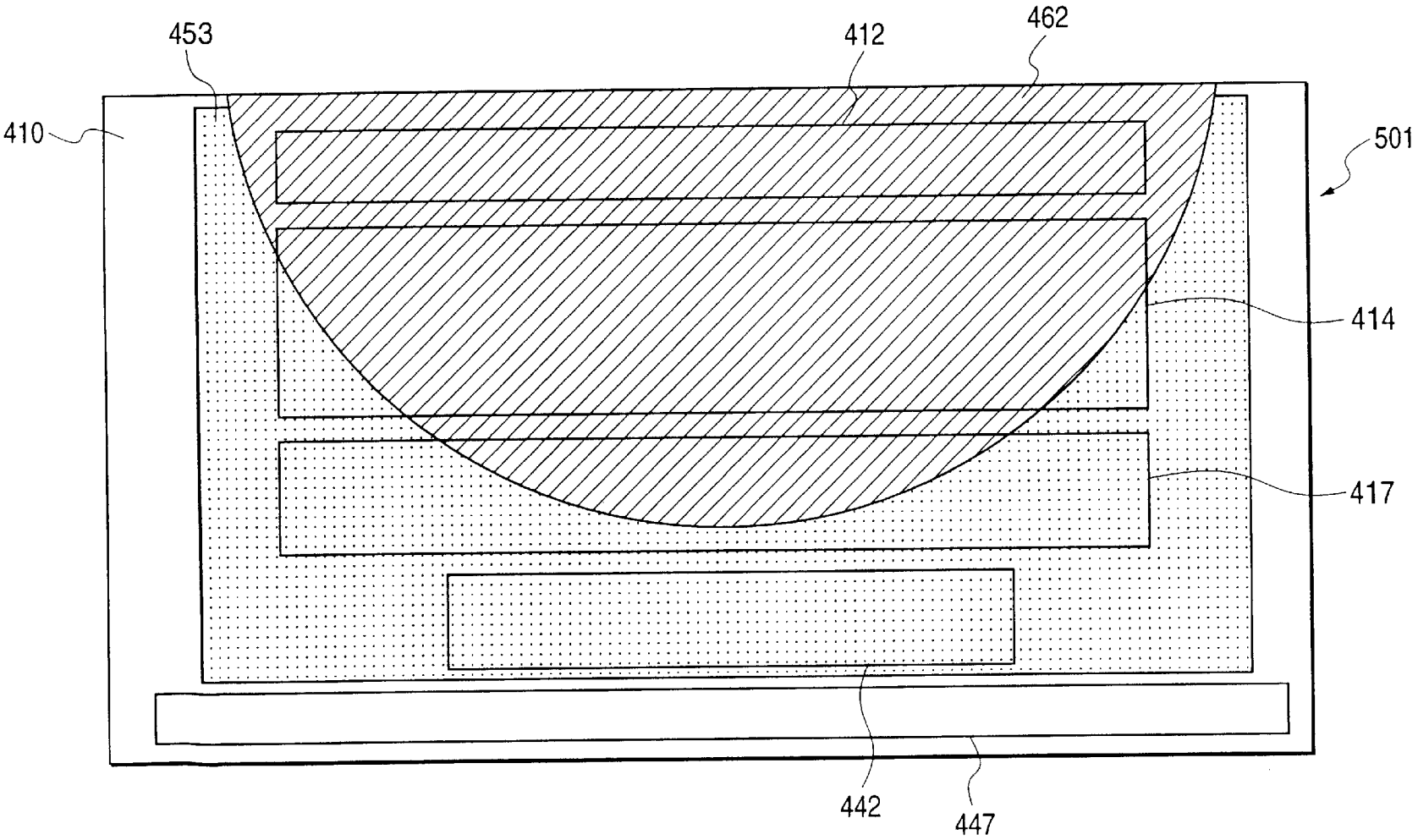
FIG. 7 is a plan view which schematically shows the inner layout of an ink jet head in accordance with one variational example.
Figure 8:
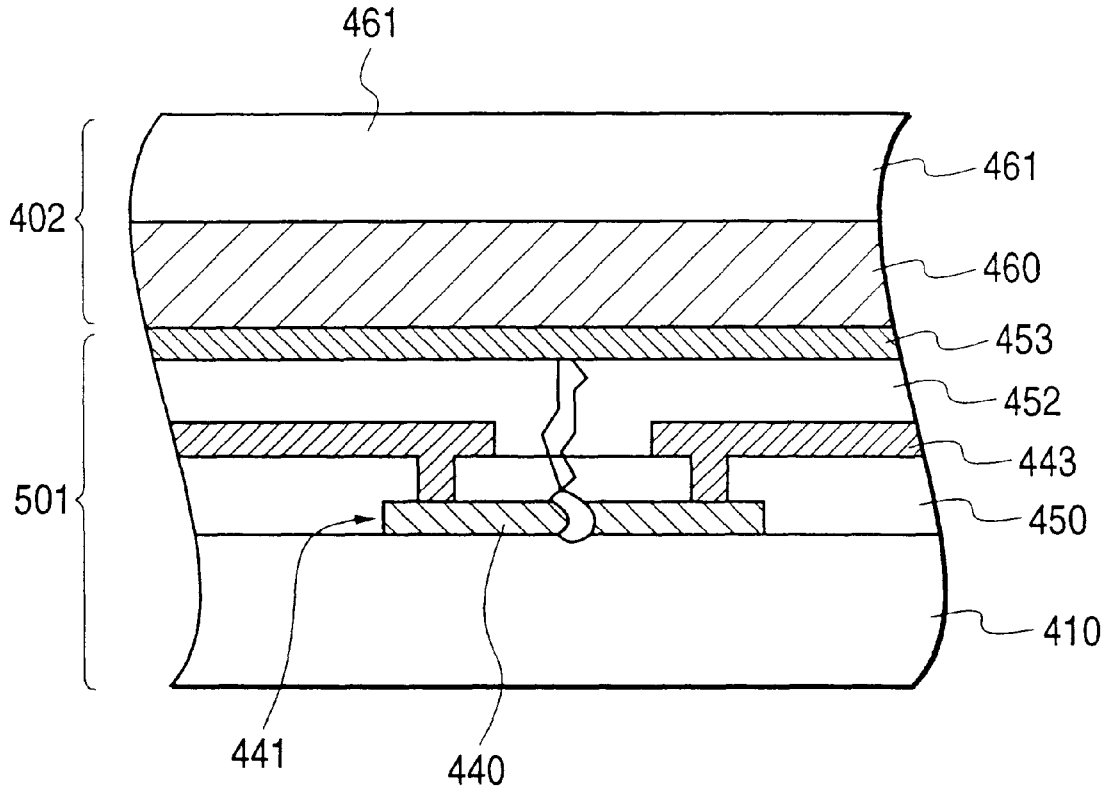
FIG. 8 is a vertically side sectional view which schematically shows the structure of the layer lamination of the ink jet head in accordance with one variational example.
Figure 9A:
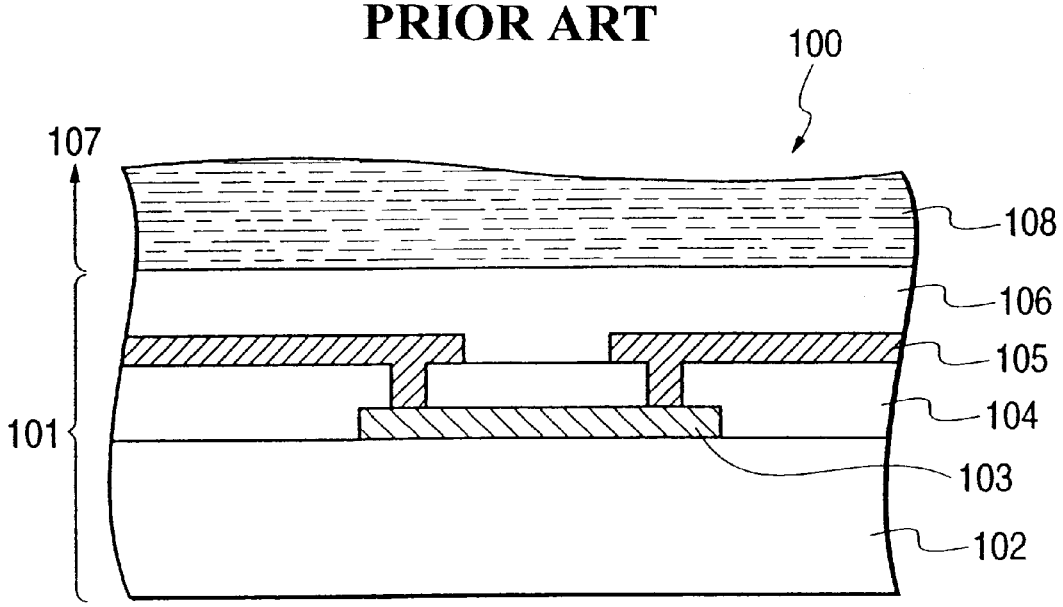
FIG. 9A PRIOR ART
FIGS. 9A and 9B are vertically side sectional views which schematically illustrate the structure of the layer lamination of the ink jet head in accordance with one conventional example.
Figure 9B:
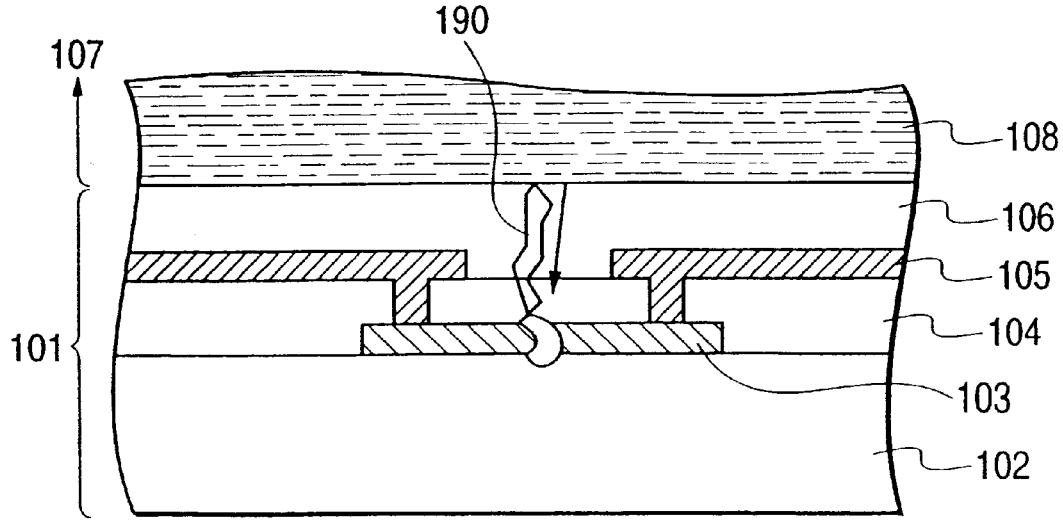
FIG. 9B PRIOR ART

Hereinafter, with reference to FIG. 1 to FIG. 8, the description will be made of a first embodiment in accordance with the present invention. In this respect, FIG. 1 is a plan view which schematically shows the inner layout of an ink jet head in accordance with a first embodiment of the present invention. FIG. 2 is a block diagram which schematically shows the structure of the layer lamination of the ink jet head. FIG. 3 is a vertically side sectional view which schematically shows the structure of the layer lamination of the ink jet head. FIG. 4 is a perspective view which shows the external appearance of an ink jet printer. FIG. 5 is a block diagram which schematically shows the structure of the circuit of the ink jet printer. FIG. 6 is a time chart which shows the relationships between each of the various signals. FIG. 7 is a plan view which schematically shows the inner layout of an ink jet head in accordance with one variational example. And FIG. 8 is a vertically side sectional view which schematically shows the structure of the layer lamination of the ink jet head in accordance with one variational example.

As shown in FIG. 5, the image processing system 200 of the present embodiment is provided with the host computer 210 that serves as the central control device, and the ink jet printer 300 which serves as the image forming apparatus. The ink jet printer 300 and the host computer 210 is connected by use of the communication cable 220.

In accordance with the present embodiment, the ink jet printer 300 is provided with the ink jet head 400, as shown in FIG. 4. The ink jet head 400 is provided with the head substrate 401 and the covering member 402 as shown in FIG. 3. The head substrate 401 is provided with the base substrate 410 as shown in FIG. 1 and FIG. 2. On the surface of the base substrate 410, each of the members are formed by means of layer films, and others.

For the head substrate 401 of the present embodiment, many numbers of the heater devices 411 are formed on the front edge potion of the surface of the base substrate 410. With the many numbers of heater devices (elements) 411, the ink discharge mechanism and the heater unit 412 are formed. To each one end of the many numbers of the heater devices 411, each source electrode of many power transistors 413 is connected individually. With these power transistors 413, the driver circuit (driver unit) 414 is formed.

The other end of each heater devices 411 and each of the drain electrode of the many power transistors 413 are connected with a pair of source-supply electrodes 415 and 416, respectively. Then, to the gate electrode of the many power transistors 413, many numbers of the AND gates 418 of the print logic circuit (logic circuit unit) 417 are connected each individually. The heater device 411 is formed by the layer film whose material is tantalum nitride, tantalic aluminum, tantalic silicon nitride, or the like. The heater device is heated by the driving electricity supply from the source-supply electrodes 415 and 416 through the driver circuit 414.

The many numbers of the AND gates 418 are divided into a plurality of control blocks with the matrix wiring. As a result, a plurality of block electrodes 419 are connected with the many numbers of the AND gates 418 per control block. Further, one pulse electrode 420 and one latch circuit 421 are also connected to the many numbers of the AND gates 418. Then, to the latch circuit 421, the shift registers 422 are connected in parallel.

To the latch circuit 421 and the shift register 422, one resetting electrode 423 is shareably connected. And each of the available clock electrodes 424 and 425 is connected individually. To the shift register 422, one data electrode 426 is also connected.

To the block electrode 419, the selection signals are inputted to select a plurality of control blocks of the many heater devices 411. The pulse electrode 420, the heat pulses are inputted to control the heating period of the heater devices 411. To the resetting electrode 423, the resetting signal is inputted to reset the latch circuit 421 and the shift register 422. To the clock electrodes 424 and 425, the clock signals are inputted to determine the operating frequencies of the latch circuit 421 and the shift register 422.

The printing data are inputted to the data electrode 426 serially. Then, the serial printing data are converted by the shift register 422 into the parallel data. The parallel data thus produced are provisionally held by the latch circuit (latches) 421, and supplied to the driver circuit 414 through the AND gates 418. In this manner, the many heater devices 411 are heated in accordance with the printing data.

Also, on the surface of the base substrate 410, the sensor unit (sensors) 430 is formed with the temperature sensor and heat-retaining heaters. Then, a pair of sensor electrodes 431 are connected to the sensor unit 430. Also, a pair of power-supply electrodes 432 and 433 are formed. The power-supply electrodes 432 and 433 are connected with each of the units, respectively.

The sensor unit 430 executes the heat-retaining heating and the temperature measurement of the base substrate 410. Then, the control signals of the sensor unit 430 are inputted to the sensor electrodes 431. Since the driving electricity supplied to each of the units is supplied to the power-supply electrodes 432 and 433, the print logic circuit 417 is driven by this supply of driving electricity.

Then, for the head substrate 401 of the present embodiment, the fuse array 441 is also formed on the surface of the base substrate 410 with the many numbers of fuse devices (elements) 440, and the fuse logic circuit 442 is arranged to surround the fuse array 441.

The many numbers of the fuse devices 440 are connected with one fuse logic circuit (fuse and logic circuit unit) 442 by use of the many numbers of fuse electrodes 443 each individually. Then, to the fuse logic circuit 442, the data electrode 444, the clock electrode 445, and the enable electrode 446 are connected, respectively.

On the fuse array 441, there are recorded before delivery the various data, such as the ID code of the ink jet head 400, the operational properties of the heater unit 412, among some others, thus enabling the fuse logic circuit 442 to control the data recording and the data reading of the fuse array 441. As described above, the fuse array 441 is formed in a storage capacity of 100 bits or less, because the data that should be stored here are the ID codes and the operations properties.

As shown in FIG. 6, therefore, the clock electrode 445 receives the clock signal that determines the operating frequency of the fuse logic circuit 442, and the enable electrode 446 receives the enable signal that allows the fuse logic circuit 442 to operate. The data electrode 444 receives the data that the fuse logic circuit 442 stores on the fuse array 441. Then, the fuse logic circuit 442 outputs the data read out from the fuse array 441.

Here, each of the various electrodes 415 . . . is a collective term of the wiring lines and connecting pads, and as shown in FIG. 1, the pad unit 447, which is the data input unit formed by the connecting pads of many numbers of electrodes 415 . . . , is formed on the rear edge portion of the base substrate 410 which is opposite to the heater unit 412.

In other words, for the head substrate 401 of the present embodiment, the heater unit 412 is arranged on the front edge portion of the surface of the base substrate 410 as shown in FIG. 1. Then, in back thereof, the driver unit 414, the print logic circuit 417, and the fuse logic circuit 442 are arranged in that order, and the pad unit 447 is arranged on the rear edge portion of the base substrate 410.

Also, as shown in FIG. 3, the fuse devices 440 of the fuse array 441 are formed by the polysilicon layer film which is laminated directly on the surface of the base substrate 410. Then, on the upper layer of t he fuse devices 440, the interlayer insulation film 450 is formed. On the interlayer insulation film 450, the fuse electrodes 443, the heater devices 411, the heater electrode 451, and others are laminated. Then, the fuse electrodes 443 are connected with the fuse devices 440 by way of the through hole of the interlayer insulation film 450.

Further, on the upper layer, the protection film 452 is laminated, and on the surface of the protection film 452, the cavitation proof film 453 is partly laminated. In other words, for the ink jet head 400, the covering member 402 comprises the sealing member 460 and the cover substrate 461. Then, a covering member 402 of the kind is bonded to the surface of the head substrate 401, thus forming on the surface of the head substrate 401 the ink retaining portion (indicated by oblique lines) 462 formed by the nozzles, the supply paths, and the ink reservoir with the sealing members 460 as partition walls.

Now, as shown in FIG. 1 and FIG. 3, the head substrate 401 of the ink jet head 400 of the present embodiment has the cavitation proof film 453 in a position which is overlapped with the ink retaining portion 462 in the direction orthogonal to the surface thereof. Then, the fuse array 441 are arranged together with the fuse logic circuit 442 in the position which does not overlap with the cavitation proof film 453 and the ink retaining portion 462.

In this respect, the various wiring arrangements are formed with the polysilicon layer film for the heater/fuse logic circuits 417 and 442. The fuse members 440 of the fuse array 441 are also formed with the same polysilicon layer film as each of the logic circuits 417 and 442.

Now, as shown in FIG. 4 and FIG. 5, the ink jet printer 300 of the present embodiment is arranged so that the ink jet head 400 structured as described above is detachably mounted on the carriage 303 of the head traveling mechanism 302. Since the carriage 303 is movably supported by the guide shaft 304 and others so as to travel in the main scanning direction. In this manner, the ink jet head 400 is movably supported to travel in the main scanning direction.

In the position opposite to the ink jet head 400 thus supported, the platen roller 305 is arranged to hold and carry the print sheet P which serves as the recording medium. With the platen roller 305 and others, the sheet carrying mechanism 306 is formed to carry the print sheet P sequentially in the sub-scanning direction.

The head traveling mechanism 302 and the sheet carrying mechanism 306 are connected with one traveling control circuit 311. The traveling control circuit 311 is connected with the microcomputer 312. The microcomputer 312 performs the overall control of the head traveling mechanism 302 and the sheet carrying mechanism 306. Thus, means of relatively movement is formed to enable the position where the ink jet head 400 discharges ink droplets, and the surface of the print sheet P to move relatively.

To the microcomputer 312, the data input circuit 313 that serves as data input means, the data read out circuit 314 that serves as data read out means, the communication I/F 315, and others are connected, and with the communication cable 220, the host computer 210 is connected to the communication I/F 315.

The data input circuit 313 is connected with the print logic circuit 417 of the ink jet head 400 through the connection connector (not shown) of the carriage 303. The data read out circuit 315 is connected with the fuse logic circuit 442 of the ink jet head 400 through the connection connector of the carriage 303.

The data input circuit 313 supplies the printing data to the print logic circuit 417 of the ink jet head 400. The data read out circuit 314 reads out the stored data on the fuse array 441 from the fuse logic circuit 442 of the ink jet head 400.

The microcomputer 312 performs the overall control of each of the various circuits 311, 313, and 314 as described above. For example, to the data input circuit 313, the microcomputer supplies the print data which are inputted from the host computer 210 to the communication I/F 315, and outputs the stored data, which the data read out circuit 314 has read out from the ink jet head 400, to the host computer 210 through the communication I/F 315.

Also, in accordance with the present embodiment, the ink jet printer 300 is provided with an ink tank (not shown) which serves as ink supply means. The ink tank is connected by tubes with the ink retaining portion 462 of the ink jet head 400 by way of the socket member (not shown) of the carriage 303. The ink tank is filled with ink liquid in advance. Then, the ink liquid is supplied to the ink jet head 400.

In the image processing system 200 thus structured, the host computer 210 supplies the printing data to the ink jet printer 300. Then, the ink jet printer 300 prints and outputs the printing data to a print sheet P, for example.

In this case, by the overall control of the microcomputer 312, the head traveling mechanism 302 operates so that the ink jet head 400 travels in the main scanning direction, and at the same time, the sheet carrying mechanism 306 enables the print sheet P to move in the sub-scanning direction. In synchronism with the operations of these mechanisms, the data input circuit 313 inputs the printing data to the ink jet head 400.

The ink jet head 400 retains in the ink retaining portion 462 the ink liquid which is always supplied from the ink tank. Then, by means of the print logic circuit 417, the respective heater devices 411 are selectively driven to be heated in accordance with the printing data to be inputted. By the selective heating of many numbers of heater devices 411, the ink liquid in the ink retaining portion 462 is bubbled to discharge ink droplets. The ink droplets thus discharged adhere to the surface of a print sheet P which moves relatively, hence forming the dot matrix images thereon.

For the image processing system 200 of the present embodiment, the ink jet head 400 is provided with the fuse array 441. For example, therefore, the ID codes and the operational properties of the heater unit 412 are recorded as data, among some others, on the fuse array 441 sometime before the delivery after the completion of the ink jet head 400 manufacture.

Now, when the ink jet head 400, which has been delivered after the data recording as described above, is installed on the ink jet printer 300, the recorded data on the fuse array 441 of the ink jet head 400 can be read by the data read out circuit 314 of the ink jet printer 300.

As a result, it becomes possible for the ink jet printer 300 to adjust the driving power to be applied to the heater unit 412 in accordance with the operational properties of the heater unit 412 read out from the fuse array 441 of the ink jet head 400, and also, to notify the host computer 210 of the ID codes of the ink jet head 400, for example.

When the operational properties of the heater unit 412 are recorded on the fuse array 441 as the data, this recording is naturally performed after the completion of the ink jet head 400. However, as shown in FIG. 3, there may be caused a crack on the upper layer due to the fusing heat of the fuse members 440.

Here, as shown in FIG. 1, the positions of the fuse array 441 and the ink retaining portion 462 of the ink jet head 400 of the present embodiment are not overlapped. Therefore, even if the crack 490 should take place on the upper layer of the fuse array 441 due to the fusing heat as shown in FIG. 3, there is no possibility that such crack is made in the position where the ink retaining portion 462 resides.

In other words, ink liquid is not allowed to permeate up to the position where the fuse array 441 and the fuse logic circuit 442 are present. There is no possibility that fused members 440 are short circuited due to the present of the ink liquid, and that the fuse logic circuit 442 malfunctions when reading the data. There is no possibility, either, that the fuse array 441 and the fuse logic circuit 442 are eroded by the presence of the ink liquid.

In this respect, if ink liquid is allowed to permeate the gap between the head substrate 401 and the sealing member 460 of the ink retaining portion 462, the ink liquid may, conceivably, permeate up to the position where the fuse array 441 and the fuse logic circuit 442 exist. However, this problem is subjected to the contacting precision between the head substrate 401 and the covering member 402, and, in practice, it is negligible.

Particularly, the ink jet head 400 of the present embodiment is formed with the layer film positioned lower than the fuse array 441 and the heater devices 411 in the laminated structure thereof. Therefore, even if the crack is created on the upper layer by the fusing of the fuse array 441, it is difficult for the crack to be expanded to the same height of the ink retaining portion 462, hence desirably preventing the ink liquid from being permeated up to the position of the fuse array 441.

Further, in accordance with the present embodiment, the various wiring lines of each of the logic circuits 417 and 442 are formed with polysilicon layer film for the ink jet head 400. The fuse members 440 of the fuse array 441 are also formed by the same polysilicon layer film.

Here, it has been conventionally required to form the print logic circuit 417, and now, when it is formed, the fuse logic circuit 442 and the fuse array 441 can be also formed simultaneously. There is no need for any new material and any additional process for the formation of these circuits and array. The ink jet head 400 of the present embodiment has a good productivity, too. Particularly, the inventor hereof has experimentally produced the ink jet heads 400 each with the fuse array 441 formed by polysilicon, and confirmed that the productivity thereof is good, and that the properties of the fuse array 441 are also excellent.

Further, in accordance with the present embodiment, the stored data of the fused array 441 are the ID codes, the operational properties, and the like for the ink jet head 400. As a result, the storage capacity of the fuse array 441 is 100 bits or less, which does not need any ROM chip of a larger capacity for the head. As compared with a head for which a ROM chip should be installed separately, this head can be made smaller and lighter in a better productivity.

In this respect, when the ink jet head 400 of the present embodiment drives the heater devices 411 to heat ink liquid to bubble for the discharge of the ink liquid, cavitation is created. However, the influence of the cavitation is prevented by the provision of the cavitation proof film 453, and the heater devices 411 and others are not damaged.

In this respect, the present invention is not necessarily limited to the aforesaid embodiment. Various modifications may be possible within the range of purport of the invention. For the aforesaid embodiment, an ink jet printer 300 of electrothermal transducing type is exemplified for description. It may be possible to adopt an ink jet printer of electro-mechanical transducing type which utilizes the piezo devices.

Also, for the aforesaid embodiment, the ink liquid is prevented from being permeated into the fuse array 441 by making the structure so that the fuse array 441 and the ink retaining portion 462 are not overlapped as an example. However, since the ink jet head 400 of electrothermal transducing type is provided with the cavitation proof film 453 as a prerequisite, it may be possible to prevent the ink liquid from being permeated to the fuse array 441 by the utilization of this film.

In this case, as shown in FIG. 7 and FIG. 8 which illustrate the head substrate 501 of an ink jet head 500 as one variational example, it may be possible to form the cavitation proof film 453 in the direction orthogonal to the surface of the base substrate 410 up to the position where the film overlaps with the fuse array 441.

Then, even if the heat is locally generated due to the fusing of the fuse array 441, the influence of such local heating can be prevented by the presence of the cavitation film 453. Therefore, as shown in FIG. 8, the crack that may be caused by the fusing heat of the fuse array 441 is not developed up to the upper layer of the cavitation proof film 453, hence making it possible to prevent the ink liquid from being permeated to the position of the fuse array 441.

In other words, if the fuse array 441 is shielded by the presence of the cavitation proof film 453, it becomes possible to arrange the fuse array 441 in a position where it overlaps with the ink retaining portion 462. As a result, the layout freedom can be enhanced with respect to the fuse array 441 or the like so as to increase the holding capacity of the ink retaining portion 462.

Further, when the fuse array 441 and the ink retaining portion 462 are partly overlapped, it may be possible to shield only the portion where the ink retaining portion 462 overlaps with the fuse array, instead of shielding the entire surface of the fuse array 441 with the cavitation proof film 453 as described above.

However, in order to prevent the ink liquid from being permeated reliably, the fuse array 441 should be arranged in a position where it does not overlap with the ink retaining portion 462 as shown in FIG. 7. Then, it is preferable to position the cavitation proof film 453 to cover the entire surface of the fuse array 441.

Further, in accordance with the aforesaid embodiment, it has been exemplified to enhance the productivity by using the same polysilicon of the wiring lines of the logic circuits 417 and 442 for the fuse array 441 as its material. For example, however, the fuse array 441 may be formed by the same material as the one used for the heater devices 411.

In this case, too, there is no need for any new material and additional process for the formation of the fuse array 441, hence making it possible to enhance the productivity, and as described earlier, it has been confirmed by the inventor hereof that the fuse array 441 presents good operational properties when the fuse array 441 is formed by tantalum nitride, tantalic aluminum, tantalic silicon nitride, or the like used for the heater devices 411 as the material thereof.

Also, a barrier layer is formed on the lower layer of the heater devices 411, and the fuse array 441 may be formed with the same material as the barrier layer. When the barrier layer and the fuse array 441 are formed by the same material, it is preferable to use a high-fusion point metal, such as tantalum, titanium tungsten, as the material thereof. In this case, too, it has been confirmed that the productivity and the operational properties of the fuse array 441 are good.

Further, it has been exemplified that the various data are recording on the fuse array 441 in the manufacturing process of the ink jet head 400 of the aforesaid embodiment. For example, however, it may be possible to execute the data recording on the fuse array 441 of the ink jet head 400 installed on the ink jet printer 300.

Also, it has been exemplified for the aforesaid embodiment that the fuse logic circuit 442 for use of the fuse array 441 is formed separately from the print logic circuit 417 for use of the heater unit 412. However, it may be possible to form these logic circuits 417 and 442 as one piece.

Further, for the aforesaid embodiment, the ink jet printer 300 of serial type is exemplified where the print sheet P moves step by step per one line each time the ink jet head 400 reciprocates. However, it may be possible to form an ink jet printer as the line type printer where the print sheet P continuously moves with respect to the fixed line head or as the XY plotter or the like where the dot head moves in the XY directions with respect to the fixed print sheet P.

What is claimed is:

1. A head substrate for an inkjet head discharging ink liquid retained in an ink retaining portion by an ink discharge mechanism in accordance with printing data inputted from the outside into a data input portion, comprising:

one base substrate having a specific position on the surface thereof for said ink retaining portion to be arranged;

a heater element provided to said ink discharge mechanism and formed on said base substrate in a position below said ink retaining portion for bubbling ink liquid by the application of heat;

a fuse array storing various freely readable data by selective fusing, said fuse array being formed in a layer beneath said heater element and being covered by a protection layer for protecting said heater element; and a fuse logic circuit for controlling the operation of selective fusing of said fuse array and data reading, wherein said fuse array and said fuse logic circuit are arranged in a position in the direction orthogonal to the surface of said base substrate, but not overlapping with said ink retaining portion.

2. A head substrate according to claim 1, wherein a cavitation proof film is provided at least in a position between said heater element and said ink retaining portion for preventing the cavitation influence of ink liquid, and said cavitation proof film is formed in the direction orthogonal to the surface of said base substrate up to a position overlapping with said fuse array and said fuse logic circuit.

3. A head substrate for an ink jet head discharging ink liquid retained in an ink retaining portion by an ink discharge mechanism in accordance with printing data inputted from the outside into a data input portion, comprising:

one base substrate having a specific position on the surface for said ink retaining portion to be arranged;

a heater element formed on said base substrate in a position below said ink retaining portion as said ink discharge mechanism to bubble ink liquid by the application of heat;

a cavitation proof film positioned at least in the gap between said heater element and said ink retaining portion for preventing the cavitation influence of ink liquid;

a fuse array storing various freely readable data by selective fusing, said fuse array being formed in a layer beneath said heater element and being covered by a protection layer for protecting said heater element; and a fuse logic circuit for controlling the operation of selective fusing of said fuse array and data reading, wherein said cavitation proof film is formed in the direction orthogonal to the surface of said base substrate up to a position overlapping with said fuse array and said fuse logic circuit.

4. A head substrate for an ink jet head discharging ink liquid retained in an ink retaining portion by an ink discharge mechanism in accordance with printing data inputted from the outside into a data input portion, comprising:

one base substrate having a specific position on the surface for said ink retaining portion to be arranged;

a heater element formed on said base substrate in a position below said ink retaining portion as said ink discharge mechanism to bubble ink liquid by the application of heat;

a cavitation proof film positioned at least in the gap between said heater element and said ink retaining portion for preventing the cavitation influence of ink liquid;

a fuse array storing various freely readable data by selective fusing, said fuse array being formed in a layer beneath said heater element and being covered by a protection layer for protecting said heater element; and a fuse logic circuit for controlling the operation of selective fusing of said fuse array and data reading, wherein said ink retaining portion and said fuse array are arranged in a position in the direction orthogonal to the surface of said base substrate at least overlapping partly, and said cavitation proof film is formed up to a position overlapping with said fuse array and said fuse logic circuit.

5. A head substrate according to any one of claims 1–4, wherein said fuse array is formed with the same material as said heater element.

6. A head substrate according to any one of claims 1–4, wherein a barrier layer is formed on the lower layer of said heater element, and said fuse array is formed with the same material as said barrier layer.

7. A head substrate according to any one of claims 1–4, wherein a print logic circuit having various wiring lines is formed on said base substrate to control the operation of said ink discharge mechanism, and said fuse array is formed with the same material of the wiring lines of said print logic circuit.

8. A head substrate according to any one of claims 1–4, wherein said fuse array is formed with layer film on a lower layer of said heater element.

9. An inkjet head comprising:

a head substrate according to any one of claims 1–4, and a covering member shielding the surface of said head substrate concavely to form said ink retaining portion.

10. An ink jet printer comprising:

an ink jet head according to claim 9;

ink supply means for supplying ink liquid to said ink retaining portion of said ink jet head;

data input means for inputting printing data into said data input portion of said ink jet head;

relatively moving means for relatively carrying a recording medium with respect to said ink jet head; and data read means for reading out various data to said fuse logic circuit from said fuse array of said ink jet head.

* * * * *

UNITED STATES PATENT AND TRADEMARK OFFICE

CERTIFICATE OF CORRECTION

PATENT NO. : 6,390,589 B1
DATED : May 21, 2002
INVENTOR(S) : Yoshiyuki Imanaka et al.

It is certified that error appears in the above-identified patent and that said Letters Patent is hereby corrected as shown below:

Title page,
Item [57], ABSTRACT,
Line 7, “readably” should read -- readable --.

Column 2,
Line 53, “date” should read -- data --.

Column 3,
Line 19, “achiever” should read -- achieve --; and
Line 26, “readably” should read -- readable --.

Column 4,
Line 23, “readably” should read -- readable --; and
Line 54, “palace” should read -- place --.

Column 5,
Line 2, “readably” should read -- readable --;
Line 23, “store d” should read -- stored --;
Line 27, “and the” (second occurrence) should be deleted; and
Line 35, “palace” should read -- place --.

Column 6,
Line 4, “from” should read -- form --;
Line 12, “manufacture” should read -- manufactured --;
Line 20, “manufacture” should read -- manufactured --; and
Line 60, “cally he” should read -- cally shows the --.

Column 7,
Line 36, “is” should read -- are --;
Line 44, “are” should read -- is --;
Line 56, “each” should read -- each of the --; and
Line 57, “electrode” should read -- electrodes --.

Column 8,
Line 16, “The” should read -- To the --.

Column 9,
Line 22, “t he” should read -- the --;
Line 44, “Then,” should read -- Then, the fuse members 440 of --; and
Line 60, “direction. In” should read -- direction, in --.

UNITED STATES PATENT AND TRADEMARK OFFICE

CERTIFICATE OF CORRECTION

PATENT NO. : 6,390,589 B1 
DATED : May 21, 2002
INVENTOR(S) : Yoshiyuki Imanaka et al.

It is certified that error appears in the above-identified patent and that said Letters Patent is hereby corrected as shown below:

Column 10,
Line 7, “relatively” should read -- relative --.

Column 11,
Line 32, “present” should read -- presence --.

Column 13,
Line 44, “inkjet” should read -- ink jet --.

Signed and Sealed this

Twentieth Day of August, 2002

*Attest:*

*Attesting Officer*

JAMES E. ROGAN
*Director of the United States Patent and Trademark Office*